United States Patent [19]

Candella

[11] 4,267,780

[45] May 19, 1981

[54] LOAD SUPPORTING AND HANDLING MEANS

[76] Inventor: Joseph S. Candella, 6309 Manor Rd., Niagara Falls, N.Y. 14304

[21] Appl. No.: 898,656

[22] Filed: Apr. 21, 1978

Related U.S. Application Data

[63] Continuation of Ser. No. 762,417, Jan. 25, 1977, abandoned.

[51] Int. Cl.[2] ..... B65D 19/26

[52] U.S. Cl. ..... 108/52.1; 108/57.1; 206/598

[58] Field of Search ..... 108/51.1, 52.1, 53.1, 108/57.1; 206/386, 596, 598, 599

[56] References Cited

U.S. PATENT DOCUMENTS

| | | | |
|---|---|---|---|
| 2,432,295 | 12/1947 | Donahue | 108/52.1 |
| 3,294,041 | 12/1966 | Lessheim | 108/52.1 X |
| 3,380,404 | 4/1968 | Shell | 108/52.1 |

FOREIGN PATENT DOCUMENTS

| | | | |
|---|---|---|---|
| 2404390 | 7/1975 | Fed. Rep. of Germany | 108/51.1 |
| 291343 | 6/1965 | Netherlands | 108/52.1 |
| 792694 | 4/1958 | United Kingdom | 108/51.1 |
| 1340328 | 12/1973 | United Kingdom | 108/52.1 |

*Primary Examiner*—Roy D. Frazier
*Assistant Examiner*—William E. Lyddane
*Attorney, Agent, or Firm*—Ashlan F. Harlan, Jr.

[57] ABSTRACT

A load-supporting and handling device which comprises a permanent base so constructed as to permit it to be lifted by a fork-lift truck and a separable, disposable load or pallet board adapted to support a load and to be lifted by a fork-lift truck independently of the base.

1 Claim, 9 Drawing Figures

45
47
47
47
49
49

53
51
55
55
55

65
63
65
61
59
63

69
67
71
71

77
79
77
77
77
77
77
79
75
79
75
81
79
77

85
83
87
87
87

LOAD SUPPORTING AND HANDLING MEANS

This application is a continuation of application Ser. No. 762,417, filed Jan. 25, 1977, now abandoned.

BACKGROUND OF THE INVENTION

This invention relates to load-supporting and handling devices and is particularly concerned with pallets adapted to be used in combination with load or pallet boards to form loading platforms. It is now quite common to transport and store articles and packages, such as bags, boxes, kegs and the like, on pallets. This makes it easy to move and store the goods. However, the pallets occupy considerable space and their use is therefore expensive when they are shipped along with the goods, and is even more expensive if the pallets must be sent back to the shipper. It is, therefore, desired to reduce the expense of pallet handling while still retaining its convenience.

SUMMARY OF THE INVENTION

The present invention provides load-supporting and handling devices each of which comprises a permanent and reusable pallet base that has a plurality of spaced supporting members, adapted to rest on a floor, and a plurality of base panels, adapted to be engaged by a fork-lift truck, extending laterally from said supporting members and a separable, disposable load or pallet board formed of a load-supporting panel, having substantially the same horizontal dimensions as the pallet base, supported on the latter by a plurality of spaced runners. Said load-supporting panel is rigid and vertically spaced from the base whereby it may be independently picked up by a fork-lift truck.

SHORT DESCRIPTION OF THE DRAWINGS

Figures 4, 5, 6, 7, 8, 9:
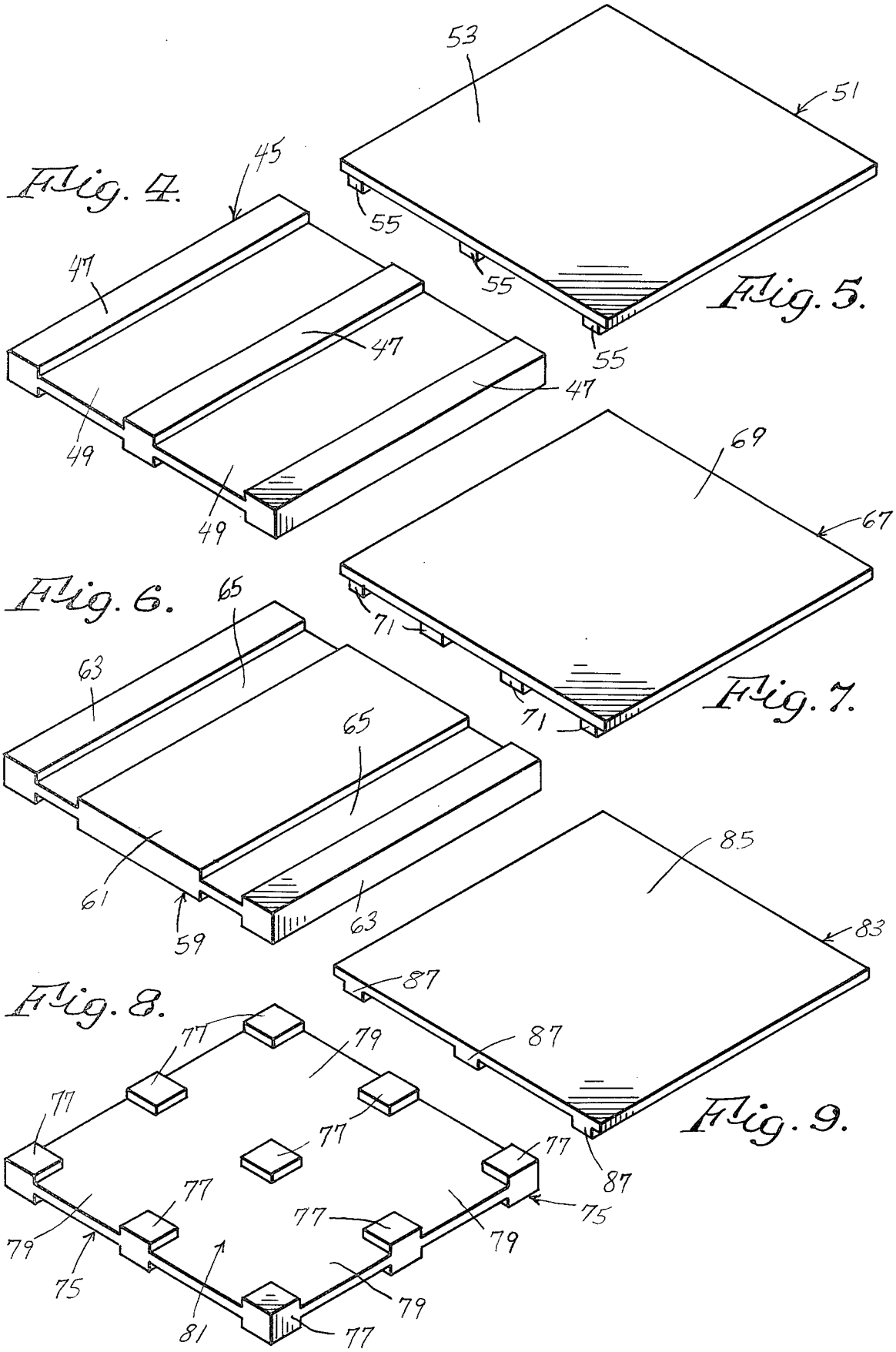

FIGS. 4, 6 and 8 are perspective views of other designs for a pallet base; and FIGS. 5, 7 and 9 are perspective views, respectively, of designs for load or pallet boards, particularly for use with the pallet bases illustrated in FIGS. 4, 6 and 8, respectively.

DESCRIPTION OF THE INVENTION

Where used herein the terms "upper", "lower", "top", "bottom", "right", "left", "above", "below", "vertical", and "horizontal", and similar terms of position and/or direction refer to the illustrations in the drawings, but are used only for convenience in description and/or reference. Such terms should not be so construed as to imply a necessary positioning of the structure or portions thereof or as to limit the scope of this invention. In the following description and the appended claims the longitudinal direction is arbitrarily considered to run from the left-hand edge to the right-hand edge and vice versa.

Figure 1:
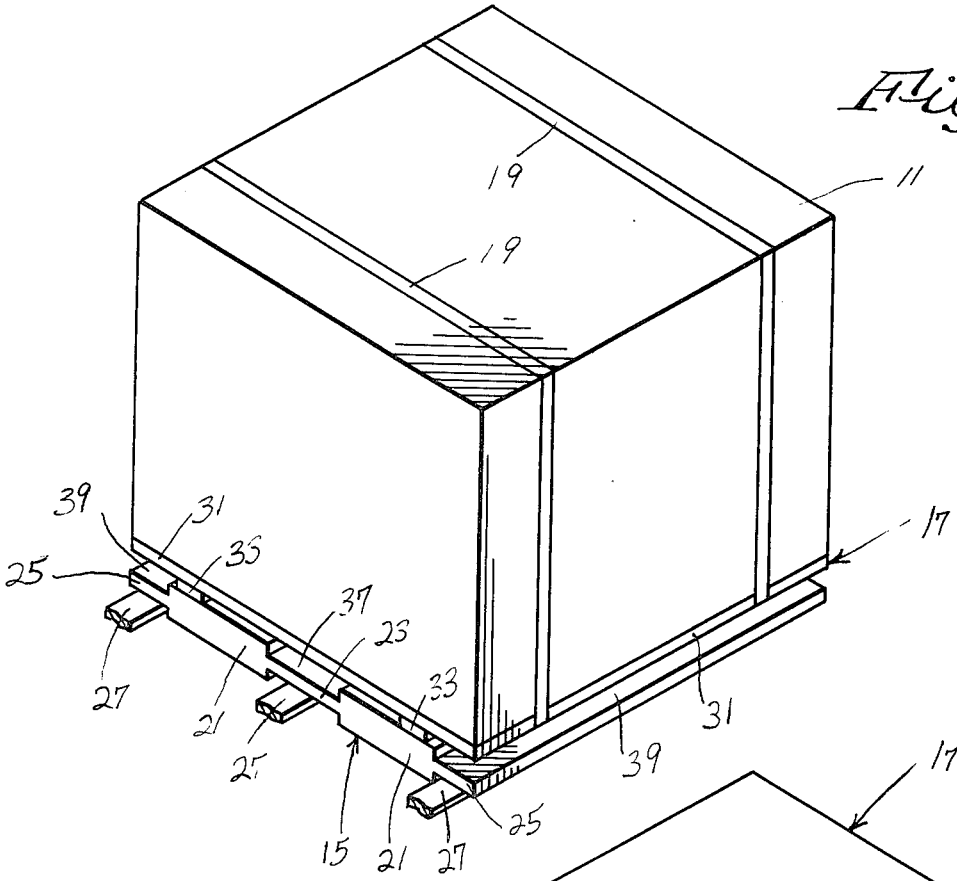
FIG. 1 is a perspective view of a pallet according to the present invention with a load, represented by a box, mounted thereon and strapped to the load or pallet board.

In the embodiment illustrated in FIG. 1, a box or crate 11 is shown carried on load-supporting and handling means according to the present invention. Such means, for convenience called a pallet, comprises a base 15 and a pallet board or load board 17 to which, as shown, the box 11 may be firmly secured by straps 19. The pallet base 15, which is preferably permanent and reusable, comprises a pair of elongated, parallel, spaced supports 21 which are joined along their longitudinal facing edges by a base panel 23. Also joined to and projecting from the longitudinal outer edge of each of the supports 21 is a panel 25. The base panels 23 and 25 are rigid and adapted for use in lifting the base 15 even when the latter is loaded. The lifting can be accomplished by any suitable means, for example, by slings (not shown), but is most conveniently performed by a fork-lift truck. In the use of the embodiment shown in FIGS. 1–3, a three-pronged fork-lift truck is preferred for the lifting, the three prongs 27 thereof (FIG. 1) being inserted longitudinally under the panels 23, 25 of the base. Preferably, the base panels extend outwardly from the vertical centers of the edge faces of the supports 21. However, if desired, they may be located nearer the upper or lower faces of the supports. The pallet base 15 may be made of any suitable material. For example, they may be formed from sheet metal, molded and reinforced plastics, or wood and preferably they are integral in construction.

The load board or pallet board 17, which is disposable, comprises a rigid sheet or large panel 31 having secured on its lower face a pair of spaced, parallel runners 33 adapted to rest, when the base and load board are combined, on the parallel supports 21 of the base. Preferably, the load board 17 is relatively thin and its horizontal dimensions are substantially the same as those of the pallet base 15. It will be evident that the base and load board can be used together or the load board with a load thereon can be used without the base. Disposable or expendable load boards may have panels or heavy corrugated board, masonite, plywood, or particle board and the runners 33 may be formed of the same or some other suitable, inexpensive material.

Pallets according to the present invention are very convenient to use. Goods in bags, boxes, barrels, crates, or other packages can be loaded on a pallet consisting of a base and a load board and stored in a warehouse preparatory to shipping. When the goods are to be shipped, the entire pallet can be picked up by a fork-lift truck and moved into a transport truck or railway car from which it can be subsequently removed in the same way. Since, however, the pallet base is a permanent one and the pallet board or load board is separable and disposable, it is possible to lift only the pallet board carrying the goods for shipping, leaving the base, and another pallet base is provided, if desired, at the destination by the receiver of the goods. In lifting the pallet board from the base, the tines or prongs 27 of the fork are inserted in the slots or spaces 37 and 39 (FIG. 1) between the sheet 31 and the base panels 23, 25.

FIGS. 4–9, inclusive, illustrate three other embodiments of pallets embodying the principles of the invention which are adapted for use with a fork-lift truck having only two tines or prongs.

In FIG. 4, the pallet base 45 comprises three parallel, spaced, longitudinal supports 47, the center support being joined to the two outer ones by longitudinal base panels 49 of reduced thickness that extend laterally from the longitudinal edge faces of the respective supports. The load board 51, shown in FIG. 5, is designed for use with the base 45 and is similar to the load board 17. It comprises a rigid sheet 53 of substantially the same horizontal dimensions as the base which is provided on its lower surface with spaced, parallel, longitudinal runners 55, one in the middle and one adjacent each of the longitudinal edges of the sheet.

FIG. 6 illustrates an embodiment similar to that shown in FIG. 4 in which the base 59 comprises three spaced, parallel, longitudinal supports, the middle support 61 being of greater width than the two outside supports 63. The support 61 is joined to each of the outer supports 63 by base panels 65 which are of reduced thickness and extend laterally from the longitudinal edge faces of the respective supports. The load board 67, illustrated in FIG. 7 and intended for use with the base 59, comprises a rigid sheet 69 which has substantially the same horizontal dimensions as the base 59 and carries on its lower surface four spaced, parallel, longitudinal runners 71. The outer two runners 71 rest, respectively, on the supports 63 of the base when the pallet base and load board are combined and the two interior runners rest on the wider center support 61.

In FIG. 8 there is illustrated an embodiment of the invention which consists of a pallet base which is so designed as to permit it to be picked up by a fork-lift truck from any of its four sides, thus simplifying loading and unloading. The pallet base 75 of this embodiment comprises 3×3 rectangular array of spaced, block-like, supporting members 77. A rigid base panel 79 joins each of the four members 77 of the four 2×2 arrays which make up the 3×3 array of supporting members. The panels 79 are of less thickness than the supporting members 77 and extend laterally from the edge faces of the members. For convenience, the minor base panels 79 are preferably joined, as shown, in the form of a larger, unitary sheet or panel 81 which joins all of the members 77. The supporting members 77 can be of any desired and convenient size and shape.

FIG. 9 shows a load board 83 suitable for use with the base 75 shown in FIG. 8 in forming a complete pallet according to the invention. The load board 83 is substantially similar to the load board 51 illustrated in FIG. 5 and comprises a rigid panel or sheet 85, having substantially the same horizontal dimensions as the base 75, provided on its lower surface with three spaced runners 87. The runners are parallel and extend longitudinally of the sheet 85 with one runner being located adjacent each of the longitudinal edges of the sheet and the third runner being located midway between the first two. If desired, the runners 87 may be cut away to provide for entry of the prongs of a fork-lift truck transversely under the load board 83.

Figure 2:
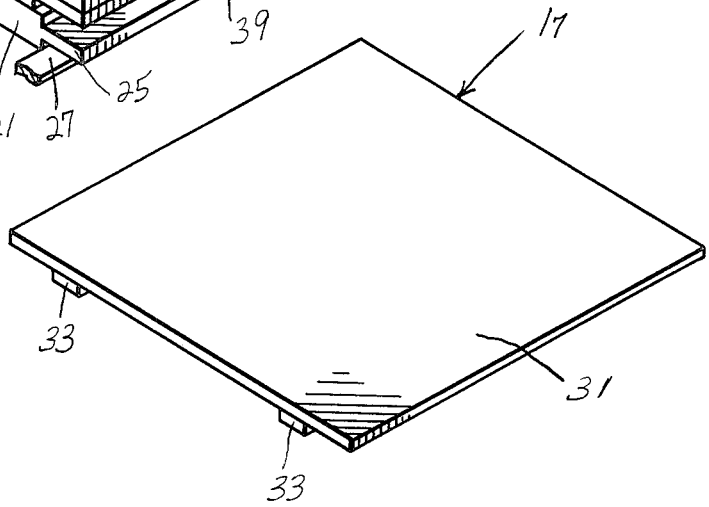
FIG. 2 is a perspective view of the pallet board shown in FIG. 1.
Figure 3:
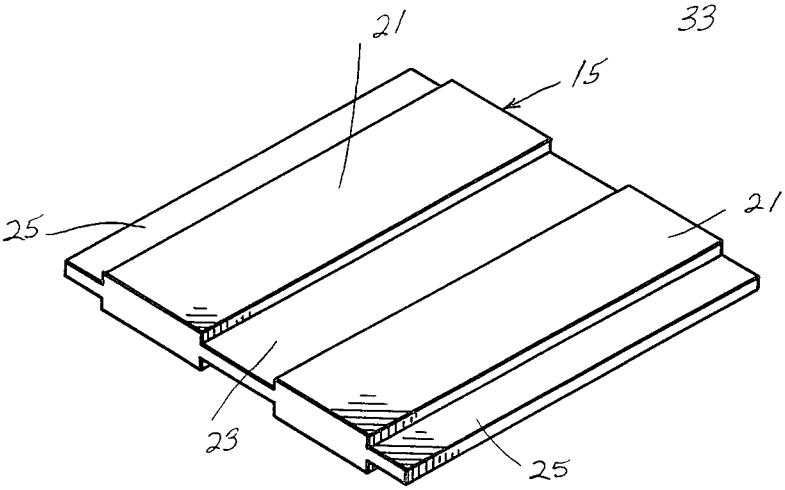
FIG. 3 is a perspective view of the base for the pallet board shown in FIG. 1.

It will be understood that the devices of the embodiments illustrated in FIGS. 4–8 may be used in substantially the same way as the pallet illustrated in FIGS. 1–3 and that the pallet bases and load boards of the former can be constructed in the same manner and of the same materials as the latter. It will also be evident that where the base panels extend from substantially the vertical centers of the supporting members, the resulting pallet bases are reversible and may be used with the load boards mounted on either face of the base.

Pallets are usually provided in certain standard sizes but for some uses odd sizes are desired. The pallets of the present invention can be made in any desired size and the dimensions of the supporting members may be varied as desired or necessary. The base panels and load-supporting panels may be of desired thickness, which will depend on the load to be carried and the inherent rigidity of the material used. Ordinarily, since the load board is disposable, a minimum thickness thereof is indicated, while the panels of the base, which is intended to be used repeatedly, will be thicker. The present invention makes possible easy and convenient handling and storage of goods with economy since expensive pallets are not disposed of and the expense of shipping pallet bases is eliminated.

It will be understood that numerous variations from and modifications of the embodiments herein described and illustrated can be made without departing from the spirit of the present invention.

I claim:

1. Load-supporting and handling means comprising:

(A) a permanent and reusable pallet base which comprises a plurality of laterally spaced, parallel supporting members of equal height adapted to rest on a floor and a plurality of base panels integral with said supporting members, said base panels having a thickness less than that of said supporting members and each extending laterally from an edge face of one of said supporting members intermediate the top and bottom thereof, at least one of said supporting members being spaced inwardly from opposite side edges of said pallet base, thereby providing spaces between said base panels and said floor in which the fork of a fork-lift truck may enter for lifting said pallet base by said panels, said base being symmetrical with respect to a horizontal plane extending through the centers of said supporting members and said panels, and (B) a disposable load board adapted to be carried by and supported on said pallet base, said load board comprising a load-supporting panel and a plurality of laterally spaced, parallel runners, said load-supporting panel having a flat, uninterrupted, upper face and substantially the same horizontal dimensions as said pallet base and said runners extending outwardly from the lower face of said load-supporting panel and being adapted to rest on and parallel to said supporting members when said pallet base and load board are assembled, thereby providing spaces between said base and said load-supporting panel for entry of the fork of a fork-lift truck, said load board having at least one runner for cooperation with each of the supporting members of said base.

* * * * *